US006003241A

United States Patent [19]

Komulainen et al.

[11] Patent Number: 6,003,241

[45] Date of Patent: Dec. 21, 1999

[54] DRYING UNIT AND DRYER SECTION THAT MAKES USE OF SUCH UNITS

[75] Inventors: Antti Komulainen, Keuruu; Juha Kaihovirta, Jyväskylä; Juha Lipponen, Palokka; Martti Salminen, Jyväskylä, all of Finland

[73] Assignee: Valmet Corporation, Helsinki, Finland

[21] Appl. No.: 09/064,427

[22] Filed: Apr. 22, 1998

[30] Foreign Application Priority Data

Apr. 22, 1997 [FI] Finland ..... 971713

[51] Int. Cl.[6] ..... D21F 5/00; F26B 11/02

[52] U.S. Cl. ..... 34/117

[58] Field of Search ..... 34/114, 115, 116, 34/117, 120, 123, 454, 457; 162/206, 209, 359.1, 375

[56] References Cited

U.S. PATENT DOCUMENTS

| | | | |
|---|---|---|---|
| 3,301,746 | 1/1967 | Sanford et al. | 162/113 |
| 3,418,723 | 12/1968 | Burgess et al. | 34/1 |
| 3,447,247 | 6/1969 | Daane | 34/122 |
| 3,541,697 | 11/1970 | Villalobos | 34/115 |
| 3,816,941 | 6/1974 | Holik et al. | 34/116 |
| 3,956,832 | 5/1976 | Justus | 34/115 |
| 4,033,048 | 7/1977 | Van Ike | 34/92 |
| 4,033,049 | 7/1977 | Schiel et al. | 34/115 |
| 4,064,637 | 12/1977 | Lindgren | 34/122 |
| 4,186,496 | 2/1980 | Beke et al. | 34/114 |
| 5,022,163 | 6/1991 | Ilvespaa et al. | 34/23 |
| 5,383,288 | 1/1995 | Ilmarinen | 34/392 |
| 5,426,867 | 6/1995 | Yli-Kauppila et al. | 34/452 |
| 5,495,678 | 3/1996 | Ilmarinen et al. | 34/117 |

FOREIGN PATENT DOCUMENTS

| | | | |
|---|---|---|---|
| 2061976 | 9/1992 | Canada | A61B 17/36 |
| 0 427 218 A2 | 5/1991 | European Pat. Off. | D21F 5/04 |
| 57457 | 9/1976 | Finland | D21F 5/18 |
| 83 679 | 3/1991 | Finland | D21F 5/02 |
| 931263 | 9/1994 | Finland | D21F 5/04 |
| 98229 | 2/1995 | Finland | D21F 5/04 |
| 964830 | 12/1996 | Finland . | |
| 22 12 209 | 9/1973 | Germany . | |
| 23 64 346 | 7/1975 | Germany | D21F 5/04 |

*Primary Examiner*—Henry Bennett
*Assistant Examiner*—Steve Gravini
*Attorney, Agent, or Firm*—Steinberg & Raskin, P.C.

[57] ABSTRACT

A drying unit in a dryer section of a paper or board machine including a drying wire guided in a loop, a large-diameter impingement-drying and/or through-drying cylinder arranged inside the drying-wire loop and smaller diameter smooth-faced heated contact-drying cylinders arranged on top of the large cylinder and/or in the vicinity thereof and at both sides thereof. The impingement-drying and/or through-drying cylinder is placed in a space below the floor level of the paper machine hall and provided with an openable and closable blow hood so that the removal of broke out of connection with the hood takes place substantially by the force of gravity. The central axes of the contact-drying cylinders placed in the vicinity of the large cylinder are placed in the vicinity of, or above, the floor level of the paper machine hall. A curve sector of the paper web on the outer face of the drying wire over the large cylinder greater than about 180°.

23 Claims, 8 Drawing Sheets

DRYING UNIT AND DRYER SECTION THAT MAKES USE OF SUCH UNITS

FIELD OF THE INVENTION

The present invention relates to a drying unit in the dryer section of a paper or board machine in which a drying wire is guided in a loop and which drying unit comprises a large-diameter impingement-drying and/or through-drying cylinder arranged inside the drying-wire loop and smooth-faced heated contact-drying cylinders having a diameter smaller than the diameter of the large-diameter impingement-drying and/or through-drying cylinder. The smooth-faced heated contact-drying cylinders are arranged on top of the large-diameter impingement-drying and/or through-drying cylinder and/or in the vicinity thereof and at both sides thereof.

The present invention also relates to a dryer section of a paper machine which comprises one or more group(s) with single-wire draw that are open towards the bottom and in which group(s) there are contact-drying cylinders in an upper row and reversing suction cylinders or rolls in a lower row, which cylinders or rolls are preferably connected to a vacuum.

BACKGROUND OF THE INVENTION

Even though, above and in the following, paper and paper machines are spoken of, in the present invention, these terms also include board and board machines.

The highest web speeds in paper machines are today up to an order of about 25 meters per second (mps) and slightly higher, but before long, a web running speed in the range of 25–40 meters per second will be commonly used. In such a case, a bottleneck for the runnability of a paper machine will be the dryer section, whose length with the prior art multi-cylinder dryers would also become intolerably long. If it is imagined that a present day multi-cylinder dryer were used in a newsprint machine at a web speed of about 40 mps, it would include about 70 drying cylinders ($\phi \approx 1800$ mm), and its length in the machine direction would be about 180 meters. In such a case, the dryer section would comprise about 15 separate wire groups and a corresponding number of draws over group gaps. It is probable that, in a speed range of 30–40 mps, the runnability of normal prior-art multi-cylinder dryers is no longer even nearly satisfactory, but web breaks would occur quite often lowering the efficiency of the paper machine.

In a speed range of 30–40 mps and at higher speeds, the prior art multi-cylinder dryers would also become uneconomical because the cost of investment of an excessively long paper machine hall would become unreasonably high. It can be estimated that the cost of a paper machine hall is at present typically about 1 million FIM per meter in the machine direction.

In the prior art, in multi-cylinder dryers of paper machines, twin-wire draw and/or single-wire draw is/are employed. When employing twin-wire draw, a group of drying cylinders comprises two closed (endless) wires, fabrics or belts which press the web one from above and the other one from below against heated cylinder faces of drying cylinders arranged in rows. Between the rows of drying cylinders, which are usually horizontal rows, the web has free and unsupported draws which are susceptible to fluttering and may cause web breaks, in particular when the web is still relatively moist and, therefore has a low strength. For this reason, in recent years, ever increasing use has been made of the single-wire draw in which each group of drying cylinders includes only a single closed (endless) drying wire on whose support the web runs through the entire group so that the drying wire presses the web on the drying cylinders against the heated cylinder faces thereof, whereas on the reversing cylinders or rolls between the drying cylinders, the web remains at the side of the outside curve and is subjected to negative pressure as it runs over the reversing cylinders in order to maintain the web on the wire. Thus, in single-wire draw, the drying cylinders are arranged outside the wire loop, and the reversing cylinders or rolls are arranged inside the wire loop.

It is known to those skilled in the art that if paper is dried one-sidedly, the result is a tendency of curling of the sheet. For example, when paper is dried by means of normal groups with single-wire draw from the side of its bottom face only, the drying is asymmetric and if such asymmetric drying is extended over the entire length of the forward dryer section, the drying takes place so that first the bottom-face side of the paper web is dried and, when the drying makes progress, the drying effect is also extended to the side of the top face of the paper web. Under these circumstances, the dried paper is usually curled and becomes concave, when viewed from above.

One parameter that illustrates the drying capacities of the prior art multi-cylinder dryers is the amount of water evaporated in the dryer section per unit of length and width, i.e., per floor area covered by the web to be dried, within a unit of time. In prior art multi-cylinder dryers, this parameter is typically in the range of 50–80 kilograms of $H_2O$ per square meter per hour.

It is known from the prior art to use various impingement-drying/through-drying units for evaporation drying of a paper web, which units have been employed in particular in the drying of tissue paper. With respect to this prior art, reference is made, by way of example, to the following patent literature: U.S. Pat. Nos. 3,301,746, 3,418,723, 3,447,247, 3,541,697, 3,956,832 and 4,033,048, Canadian Patent No. 2,061,976, West German Patent Application Nos. DE-A-22 12 209 (corresponding to U.S. Pat. No. 3,816,941) and DE-A-23 64 346 (corresponding to U.S. Pat. No. 4,033,049, European Patent Application No. EP-A2-0 427 218), Finnish Patent Nos. 57,457 (corresponding to Swedish Patent Application No. 7503134-4) and 87,669 (corresponding to U.S. Pat. No. 5,383,288), and Finnish Patent Application No. 931263 (corresponding to U.S. Pat. No. 5,495,678 and European Patent Application No. 0 620 313-A1).

OBJECTS AND SUMMARY OF THE INVENTION

A primary object of the present invention is to provide a novel dryer section concept based on evaporation drying, by whose means it is possible to utilize the space in the paper machine hall more efficiently.

With respect to the utilization of space, it is a particular object to utilize the basement space underneath the paper machine hall more efficiently, which basement space exists or is otherwise in any case needed. The efficiency of utilization of this basement space has remained relatively low with the use of so-called normal single-wire groups open towards the bottom, in which the contact-drying cylinders are placed in the upper row and the reversing suction cylinders or rolls in the lower row in the different wire groups.

Thus, it is an object of the present invention, in connection with increasing the speeds of paper machines and with modernizations, to permit the placement of a new dryer section in the place of an existing multi-cylinder dryer.

In relation to this, it is a further object of the present invention to provide a dryer section concept which makes it possible to construct dryer sections having a shorter length in comparison to prior art dryer sections.

It is a particular object of the present invention to provide a dryer section in which the removal of broke can take place primarily by the force of gravity and in which so-called inverted wire groups are not used. In inverted groups, the contact drying cylinders are placed in the lower row, the reversing suction cylinders in the upper row and the group is closed towards the bottom so that, in the event of web breaks, the removal of broke must be carried out manually, which is time-consuming and which is also work that is difficult from the point of view of safety at work.

It is a further object of the present invention to provide a dryer section in which it is possible to achieve good runnability and a substantially closed draw of the web and threading of the leader end of the web even without systems of threading ropes.

It is a further object of the invention to make it possible to provide a dryer section concept in which different evaporation devices and techniques can be applied optimally in the different stages of drying so that a short construction of the dryer section, a good quality of the paper and a runnability sufficiently free from disturbance are achieved.

Another important object of the present invention is to provide novel drying modules for a paper web and dryer sections that make use of such modules, which are suitable for use at high web speeds of v>about 25 meters per second, which speeds can be up to an order of from about 30 to about 40 meters per second or even higher.

It is a further object of the present invention to increase the drying capacity by means of impingement drying and/or through-drying and in this way, to make the length of the dryer section shorter, which contributes to an improvement of the runnability of the dryer section.

It is a further object of the invention to provide a drying method and drying equipment which are also applicable to modernizations of dryer sections.

It is a further object of the invention to provide such a drying method and drying equipment by whose means, in the above-mentioned high speed range, the length of the dryer section in the machine direction can, nevertheless, become reasonable so that its length does not substantially exceed the length of the cylinder dryers currently in operation. An achievement of this objective would permit renewals and modernizations of paper machines in existing paper machine halls up to, and even beyond, a web speed of about 40 meters per second.

It is a further object of the invention to provide a drying method and a dryer section that applies the method wherein the web is reliably affixed to the drying wire over substantially the entire length of the dryer section so that cross-direction shrinkage of the web can be substantially prevented and that, thus, cross-direction inhomogeneity in the web arising from an uneven cross-direction shrinkage profile can be avoided.

It is a further object of the present invention to provide a dryer section that permits quick changes of paper grade, and in this way, it is possible to improve the overall efficiency of operation of the machine.

It is a further object of the invention to provide a dryer section in which the removal of broke takes place primarily downward so that the times of breaks and standstills can be reduced and manual handling and disposal of the broke be practically eliminated.

It is a further object of the invention to provide a dryer section which permits profiling of the paper web that is being produced both in the machine direction and in the cross direction in view of producing a paper having a quality as uniform as possible and that complies with the different criteria of quality.

Of the prior art cited above, the dryer section concept described in the current assignee's Finnish Patent Application No. 931263 (U.S. Pat. No. 5,495,678) is most closely related to the present invention. Thus, another object of the present invention is further development and modification of this dryer section concept, which is in many respects favorable and advanced.

One embodiment of the method in accordance with the current assignee's Finnish Patent Application No. 931263 comprises a combination of the following steps (a), (b), (c), and (d):

a) the paper web is contact-dried by pressing it with the drying wire on a face of a cylinder over a sector b thereof, the cylinder having a diameter $D_2$ greater than about 1.5 m and the sector b having a magnitude greater than about 180°;

(b) evaporation drying is carried out as impingement drying and/or as through-drying by means of high-velocity drying-gas jets applied to the web on the drying wire on the face of a following large-diameter cylinder having a diameter $D_1$ greater than 2 m on a sector a >180° while the web is at the side of the outside curve;

(c) a step (a) substantially equal to that defined above is carried out;

(d) before the step (a) and/or after the step (c), the web to be dried is passed over the sector c of a suction roll, which sector c is subjected to a vacuum, while the web is supported on the drying wire at the side of the outside curve, the magnitude of sector c being greater than about 160°, and the diameter $D_3$ of the suction roll being less than the diameter $D_2$ of the cylinder.

The drying module in accordance with FI 931263 comprises a large-diameter $D_1$ impingement-drying and/or through-drying cylinder, whose diameter $D_1$>2 m and which cylinder is placed inside the drying-wire loop, and smooth-faced heated contact-drying cylinders are placed in the vicinity of the impingement-drying and/or through-drying cylinder, at both sides thereof, whose diameter $D_2<D_1$ and which contact-drying cylinders are placed outside the same drying-wire loop. In the running direction of the web, a reversing suction roll or rolls is/are placed before and/or after the contact-drying cylinder inside the same drying-wire loop and has a diameter $D_3<D_2$. The drying cylinders and reversing suction rolls are placed so in relation to one another, the contact sectors of the web and the drying wire are greater than about 180°, and the outer mantle of the impingement-drying and/or through-drying cylinder is provided with grooves and/or is penetrable by drying gas. A drying hood is provided on the contact sector a of the mantle. In the interior of the hood, in the vicinity of the outer face of the web to be dried, there is a nozzle field, through which a set of drying-gas jets can be applied at a high velocity against the free outer face of the web to be dried over a substantial area of the sector a.

In the present invention, the drying modules described in FI 931263 are applied in a novel way and the constructions of such modules and the overall configuration of the paper machine composed of them are modified and developed further. In FI 931263, the impingement-drying/through drying units are placed alternatingly as upper and lower units, and even the lower units are not placed in the basement space, but they are placed so that they can be serviced and cleaned from the floor level of the paper machine hall. Thus, the utilization of the basement space of the paper machine hall remains deficient. Also, the impingement-drying/through-drying units described in FI 931263 are difficult to service and cleanse from paper broke in the event of a web break. Moreover, the different requirements of the different stages in the drying of paper with respect to drying devices and drying techniques in view of achieving an optimal final result, utilization of space and an optimal dryer-section geometry have not been recognized in FI 931263.

In view of achieving the objects stated above and others while avoiding the drawbacks mentioned above, in the drying unit in accordance with the invention, an impingement-drying and/or through-drying cylinder is placed in the space substantially underneath the floor level of the paper machine hall and provided with an openable and closable blow hood so that the removal of broke out of connection with the hood takes place substantially by the force of gravity. The central axes of the heated contact-drying cylinders placed at both sides in the vicinity of the impingement-drying and/or through-drying cylinder are placed in the vicinity of, or above, the floor level of the paper machine hall. A curve sector b of the paper web to be dried on the outer face of the drying wire over the impingement-drying and/or through-drying cylinder is greater than about 180°.

The dryer section in accordance with the invention comprises one or more drying unit(s) in accordance with the invention, which unit(s) is/are provided with a blow hood module which is placed in the space underneath the paper machine hall. The group(s) with single-wire draw is/are placed substantially above the floor level of the paper machine hall.

In the present invention, impingement-drying/through-drying modules are applied, which are placed in connection with a large-diameter through-drying cylinder (in the following, large cylinder) and preferably in the basement space underneath the dryer section. The impingement-drying/through-drying modules are provided with hoods which can be opened quickly and simply for cleaning, such as removal of broke, and for servicing, and which can be closed likewise. For this purpose, the modules and their hoods are open or openable towards the bottom, so that removal of broke out of connection with the large cylinders can take place substantially by the effect of gravity without manual operations, at least without considerable or time-consuming manual operations. The hoods are preferably divided into two parts which are substantially symmetric in relation to the vertical plane in the cross direction of the machine and which can be displaced by means of power units mechanically in the machine direction and in the horizontal direction in view of quick and easy opening and closing of the hoods.

The diameter $D_1$ of the large cylinder is commonly selected to be greater than about 2 m, preferably between about 2 m and about 4 m. A sufficiently large diameter of the large cylinder and a sufficiently large turning sector b from about 220° to about 280° of the drying wire and the web have the effect that the web has a sufficiently long impingement-drying/through-drying distance and time on the large cylinder even at high web running speeds. Further, the diameter of the large cylinder is selected such that the large cylinder with its auxiliary equipment can be adequately accommodated in the basement space and an adequate space still remains below the large cylinder for other devices, such as a broke conveyor and air ducts.

The number of impingement-drying/through-drying modules in the basement space underneath the dryer section is generally from 1 to 5, and are preferably placed in the initial part of the dryer section. A modern high-speed dryer section can be accomplished by means of three impingement-drying/through-drying modules of this sort, together with the connected other drying devices. When impingement-drying/through-drying modules are employed in renewals/modernizations of dryer sections in connection with increasing the speed of a paper machine, generally one such module is sufficient.

Further, in the present invention, consideration has been given to the factor, decisive from the point of view of runnability of the dryer section, that, when the web is placed on the impingement-drying and/or through-drying cylinders (large cylinders) and on the reversing suction rolls, on support of the wire, at the side of the outside curve, it tends to be separated from the drying wire by the effect of centrifugal forces. The separation force is proportional to the term $2\times y^2/D_1$, wherein $D_1$ is the diameter of the large cylinder. In order to prevent this separation, on the impingement-drying and/or through-drying cylinders and reversing rolls, preferably a difference in pressure is arranged, which is measured high enough so that separation of the web is prevented in all cases and the runnability is retained also in this respect. This difference in pressure can also be used in particular on the impingement-drying and/or through-drying cylinders to promote the through-drying.

In the present invention, as the drying gas, preferably either air or superheated steam is used. The state of the drying gas is selected in each drying stage in consideration of the way in which the water is bound in the fibre mesh of the paper web in each particular drying stage. In this manner, it is possible to accomplish drying stages which are optimal both with respect to the quality of the paper, with respect to the drying, and with respect to the construction of the dryer section.

In a drying module in accordance with the invention, as an impingement-drying and/or through-drying cylinder and as a reversing suction roll, it is most advantageously possible to employ such drying cylinders and reversing suction rolls provided with grooved mantles with through perforations as are marketed by the current assignee with the trade mark VAC™-roll. Such reversing rolls are described in detail in the current assignee's Finnish Patent No. 83,680 (corresponding to U.S. Pat. No. 5,022,163). As a through-drying cylinder, it is possible to use a through-blow roll which has a higher vacuum and a larger open area. One such roll is, for example, the product marketed by the current assignee with the trade mark "HONEYCOMB" roll.

According to the invention, when the web is kept in stable contact with the drying wire substantially over the entire length of the dryer section, if necessary, by employing a difference in pressure on the curve sectors on which the web remains outside, cross-direction shrinkage of the web during drying is prevented, whereby cross-direction inhomogeneity of the web, arising from an uneven cross-direction shrinkage profile, is eliminated.

In the present invention, the hood of the impingement-drying and/or through-drying cylinder is also understood as a pressurized hood or as a counterflow hood, and/or the large cylinder can be understood as a cylinder provided with a grooved mantle or with an equivalent wire sock mantle. In such a case, the difference in pressure, by whose means the web is kept on support of the drying wire, can be produced substantially by means of the pressurization of the hood, by means of which pressurization, if necessary, the flow of the drying gases through the web can also be produced. With respect to the details of the construction and the operation of a counterflow hood, reference is made to Finnish Patent No. 83,679 of Messrs. Teollisuusmittaus Oy.

In a drying module in accordance with the present invention or in a number of successive modules, the hood of the impingement-drying and/or through-drying cylinder can be divided in the cross direction by means of walls placed in the machine direction into a number of blocks, into which drying gases of different temperature, humidity and/or pressure are passed, or in the blocks, sets of drying-gas jets of different velocities are employed. In this manner, drying of the paper web can be regulated in the cross direction, and it is possible to achieve a favorable moisture profile of a certain shape, most commonly uniform, in the cross direction.

In a dryer section in accordance with the invention, the pocket placed underneath the "large cylinder" is not generally subjected to a vacuum by means of a suction device placed inside the fabric loop, which is the case in the embodiments described in U.S. Pat. No. 4,033,048. The large cylinder, as well as the smaller reversing suction rolls placed in the gaps between the drying cylinders, for example the current assignee's VAC™ rolls, are each provided with a suction duct of their own fitted in the axle of the roll. In the '048 patent, between the large suction rolls, "middle rolls", which employ the same support fabric, there is just one outer roll, which can be heated.

When the drying method and the drying device in accordance with the invention are employed, the drying effect is applied to the paper web from the side of its bottom face preferably over the entire length of the dryer section. This results in the tendency of curling of the web mentioned above. In order to prevent this, it is possible to use various methods and devices developed by the current assignee, with respect to which reference is made by way of example to the current assignee's non-public Finnish Patent Application No. 964830 (filed on Dec. 3, 1996), and to the rest of the prior art referred to therein.

The invention will be described in detail with reference to some preferred embodiments of the invention illustrated in the figures in the accompanying drawing. However, the invention is not confined to the illustrated embodiments alone.

BRIEF DESCRIPTION OF THE DRAWINGS

Additional objects of the invention will be apparent from the following description of the preferred embodiment thereof taken in conjunction with the accompanying non-limiting drawings, in which.

DETAILED DESCRIPTION OF THE PREFERRED EMBODIMENTS

Figure 1:
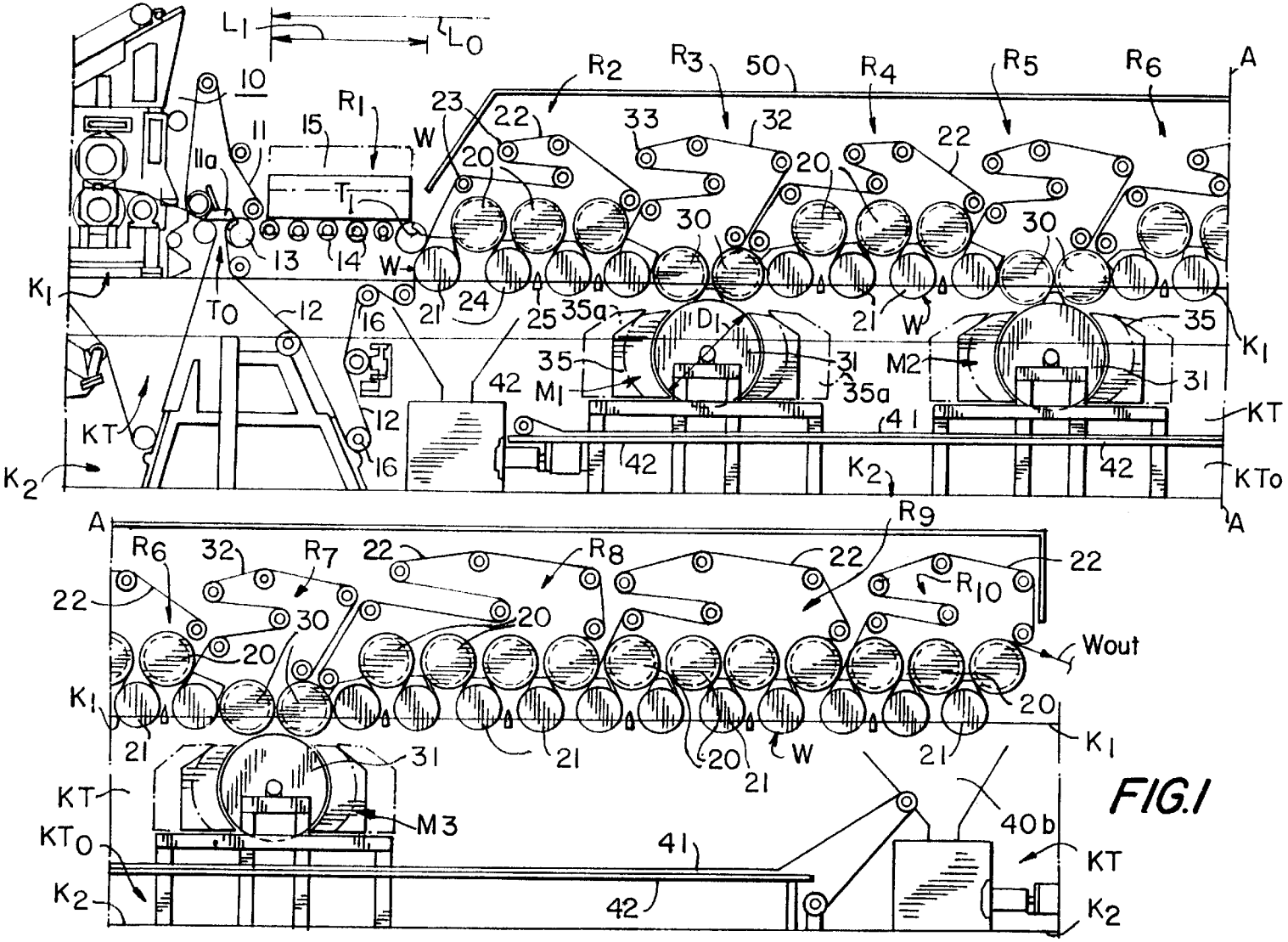
FIG. 1 shows a first preferred overall concept of the invention which includes three drying units in accordance with the invention and other dryer groups in themselves known.

Referring to FIGS. 1–8 wherein like reference numerals refer to the same or similar elements, FIG. 1 shows a particularly favorable overall concept of a dryer section in accordance with the invention. In FIG. 1, it has been necessary to illustrate the oblong dryer section as two parts, which have been placed one above the other and which parts have been cut off at the cross-direction vertical plane A—A to make parts illustrated one above the other. As shown in FIG. 1, a paper web W is p assed from a press section 10 of the paper machine having a dry solids content ko from about 35% to about 55% and a temperature To of from about 30° C. to about 65° C., on the bottom face of a press fabric 11 and supported by a PressRun™ box 11*a* onto the top face of a drying wire 12 over its guide roll 13. A first planar drying unit $R_1$ comprises a blow hood 15, under which the web W to be dried runs on the horizontal run of the wire 12, which is supported by rolls 14. The horizontal run of the wire 12 forms a plane in connection with which grooved rolls and/or suction boxes or blow boxes support the web W. In the unit $R_1$, an intensive drying energy impulse is applied to the top face of the web W, in which connection, after the unit $R_1$, the temperature $T_1$ of the web W is from about 60° C. to about 80° C. In the unit $R_1$, primarily heating of the web W and the water contained in it take place, but no substantial evaporation of water as yet. The length $L_1$ of the unit $R_1$ in the machine direction is typically of an order of from about 3 m to about 10 m.

In the unit $R_1$, the paper web runs on support of the upper run of the drying wire 12 along a substantially linear path in the horizontal plane so that it has no major changes in the direction and that, thus, no high dynamic forces are applied to it which might produce a web break in the web, which is still relatively moist and, thus, has a low strength. In the interior of the blow hood 15, there is a nozzle arrangement by whose means hot drying gases, such as air or steam, are blown against the top face of the web. Additionally or alternatively, it is possible to employ infrared heaters which direct radiation at the web. The blow devices and/or radiators in the unit $R_1$ can be arranged so that their output in the cross direction of the web is adjustable so as to provide profiling of the web W in the cross direction.

In FIG. 1, the unit $R_1$ is followed by the first so-called normal (not inverted) single-wire unit $R_2$ having a drying wire 22 onto which the web W is transferred as a closed draw in the area of a first reversing suction roll 21. The single-wire unit $R_2$, and so also the subsequent single-wire units $R_4$, $R_6$, $R_8$, $R_9$ and $R_{10}$ that are open towards the bottom comprise steam-heated contact-drying cylinders 20 arranged in an upper row and reversing suction rolls 21 arranged in a lower row, for example the current assignee's VAC-rolls™. Below the cylinders 20, there are doctors 24 and ventilation blow devices 25. The paper web W to be dried enters into direct contact with the faces of the steam-heated drying cylinders 20, and on the reversing suction rolls 21, the web W remains on the drying wire 22 at the side of the outside curve.

In FIG. 1, after the group $R_2$ with single-wire draw, there follows a drying unit $R_3$ in accordance with the invention, which comprises two contact-drying cylinders 30 and a large-diameter $D_1$ impingement-drying/through-drying cylinder 31 with a perforated mantle, which cylinder will be called a large cylinder in the following. A drying wire 32 is guided by guide rolls 33 to run around the contact-drying cylinders 30 and around the large cylinder 31. The impingement-drying/through-drying hood module $M_1$ of the drying unit $R_3$ is situated in a basement space KT underneath the floor level $K_1$—$K_1$ of the paper machine hall on support of the floor level $K_2$—$K_2$ of this space. The central axes of the contact-drying cylinders 30 in the unit $R_3$ and in the corresponding following drying units $R_5$ and $R_7$ in accordance with the present invention are placed substantially in the floor plane of the paper machine hall or in the vicinity of the plane $K_1$—$K_1$, preferably slightly above this plane. The paper web W to be dried is passed from the single—wire unit $R_2$ as a closed draw onto the first drying cylinder 30 in the drying unit $R_3$, after which the web W is passed on the wire 32 of the unit $R_3$ over the large cylinder 31 of the first module $M_1$ on a remarkably large sector b from about 200° to about 300°, preferably about 220° to about 280°, on support of the drying wire 32 and further onto the second drying cylinder 30 in the unit $R_3$. From this drying cylinder 30, the web W is transferred as a closed draw into the next normal unit $R_4$ with single-wire draw, which unit is substantially similar to the unit $R_2$ described above. After this, there follows the second drying unit $R_5$ in accordance with the invention, which unit is similar to the drying unit $R_3$ described above and whose large cylinder 31 is also placed in the basement space KT. After the drying unit $R_5$, the web W is passed as a closed draw into the next single-wire unit $R_6$, which is followed by the third drying unit $R_7$ in accordance with the invention, whose large cylinder 31 is likewise placed in the basement space KT. The drying unit $R_7$ is followed by three successive single-wire units $R_8$, $R_9$ and $R_{10}$, and the web Wout is passed from the last one of these units to the reel-up or into a finishing unit (not shown).

In the basement space, besides the modules $M_1$, $M_2$ and $M_3$, FIG. 1 also shows pulpers 40*a* and 40*b*, between which there is a broke conveyor 41, which carries the paper broke into the pulper 40*a* and/or 40*b*. In the event of a web break, the web W can be passed after the unit $R_1$ directly into the pulper 40*a* placed underneath. The single-wire units $R_4$, $R_6$, $R_8$, $R_9$ and $R_{10}$ are open towards the bottom, and therefore the paper broke falls from them by the effect of gravity onto the broke conveyor 41 placed underneath or directly into the pulpers 40*a*,40*b*. Also, the modules $M_1$, $M_2$ and $M_3$ are open or openable towards the bottom so that the paper broke falls out of connection with them, substantially by the effect of gravity, without major manual operations, onto the broke conveyor 41 placed underneath.

Underneath the modules $M_1$, $M_2$ and $M_3$, above the floor level $K_2$—$K_2$ of the basement space KT, there is still space KTo for various devices, such as ducts through which the heating medium, such as heated air or steam, is passed into the interior of the hoods 35 of the modules $M_1$, $M_2$ and $M_3$. The lower space KTo is defined from below by the floor level $K_2$—$K_2$ of the basement space and from above by a partition wall 42 placed below the broke conveyor 41. On the drying units $R_2, \ldots, R_{10}$, there is an air-conditioned hood 50 in itself known.

Figure 2:
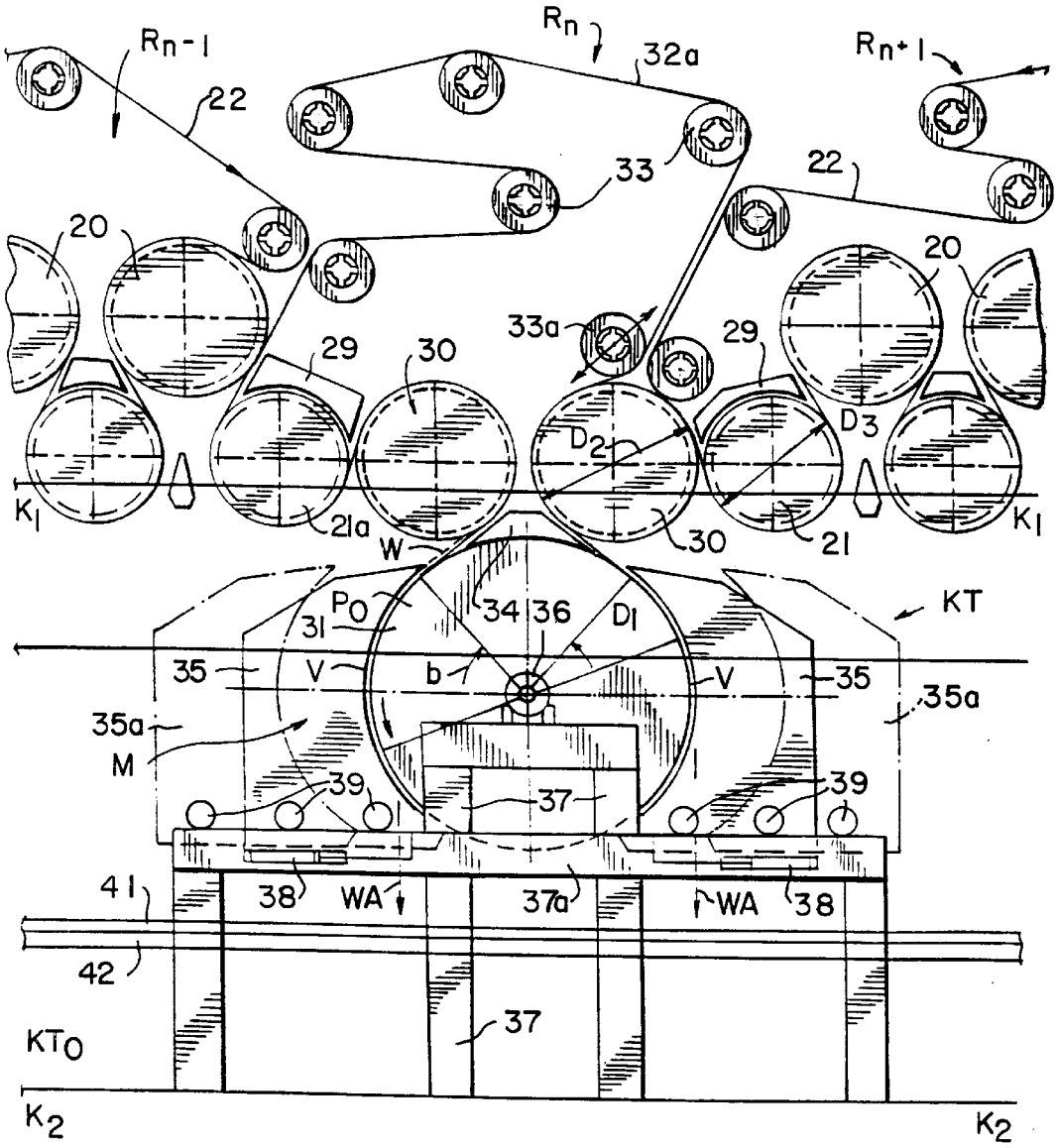
FIG. 2 is a more detailed side view of a drying unit and an impingement-drying hood module in accordance with the invention.

FIG. 2 is a more detailed illustration of the impingement-drying/through-drying hood module M in accordance with the invention. As shown in FIG. 2, the wire 32*a* which runs around the large cylinder 31 is first passed around a reversing cylinder 21*a* aligning with the reversing cylinders 21 in the preceding group $R_{n-1}$ with single-wire draw onto the first contact-drying cylinder 30 in the unit $R_n$, from the first contact-drying cylinder further as a short straight run over the sector b of about 280° of the large cylinder 31 onto the second contact-drying cylinder 30 in the group $R_n$ and over this cylinder on a sector of about 90°. After this, the web W follows the face of the cylinder 10 and is transferred as a closed draw onto the drying wire 22 of the next group $R_{n+1}$. The hood of the large cylinder 31, which comprises two parts or hood halves 35, covers the cylinder substantially over the entire curve sector b of the web W. On the sector b, the web W remains on the wire 32*a* at the side of the outside curve, i.e., so that its outer face is free or exposed. The large cylinder 31 is mounted on its axle journals 36, through which a communication is arranged with vacuum devices (not shown), by means of which a suitable vacuum is produced in the interior of the cylinder 31, the vacuum being of an order of po from about 1 kPa to about 3 kPa. This vacuum po keeps the web W on the wire 32*a* when the web W is at the side of the outside curve and, at the same time, the vacuum po also promotes possible through-drying taking place through the web W and the wire 32*a*. The sector 360° -b that remains outside the sector b on the large cylinder is covered by a sealing arrangement such as a cover plate 34 placed in the gap between the drying cylinders 30, and so also the reversing cylinder of the group $R_n$, which can also be called the last cylinder 21*a* in the group $R_n$, is covered by an obstacle plate 29. In a more detailed embodiment, the perforated and grooved outer mantle 31*a* of the large cylinder 31 is, for example, similar to that described in FI 931263 and illustrated above all in FIG. 11 thereof, so that the construction is not described again herein.

The large cylinder 31 is mounted by means of its axle journals 36 on support of a frame construction 37. In this frame construction, both at the driving side and at the tending side, there are horizontal frames or beams 37*a*, on whose top face, or on rails provided on the top face, the hood halves 35 are arranged to be movable on wheels 39, which hood halves are illustrated in the open position 35*a*, in which the module M can be serviced. The hood halves 35 are displaced into the open and closed positions by actuating means such as cylinders 38. The module M and its hood 35 are open towards the bottom so that broke can be removed in the direction of the arrows WA substantially by the effect of gravity onto the broke conveyor 41 placed underneath without substantial manual operations, also when the hood halves 35 are in the closed position. The top face of the hood half 35 has been shaped as smoothly downwards inclined so as to improve the removal of broke.

Further, in the open position 35*a* of the hood 35, the module M can also be serviced and cleaned easily in other respects. The diameter $D_1$ of the large cylinder 31 is selected to be greater than about 2 m, generally in the range of from about 2 m to about 8 m, preferably from about 2 m to about 4 m. The diameter $D_2$ of the drying cylinders 30 in the group $R_n$ is selected in the range of from about 1.5 m to about 2.5 m, preferably in the range of from about 1.8 m to about 2.3 m. In the groups $R_{n-1}$ and $R_{n+1}$ with single-wire draw, the diameter of the drying cylinders 20 is preferably about the same as the diameter $D_2$. The diameter $D_3$ of the reversing suction cylinders 21,21*a* is selected in a range of from about 0.6 m to about 1.8 m, preferably from about 1.0 m to about 1.5 m.

The wire 32*a* guide roll 33*a* placed above the latter drying cylinder 30 can be stationary or displaceable. Between the groups $R_{n-1}$, $R_n$ and $R_{n+1}$, a small difference in speed is employed, which is generally about 0.1% to about 0.2%, so that, in particular in the initial end of the dryer section on the wires 22,32*a*,22, the speed becomes higher when the web W moves forwards. In the final end of the dryer section, the speed can also be reduced because of shrinkage of the web in the machine direction.

Figure 3:
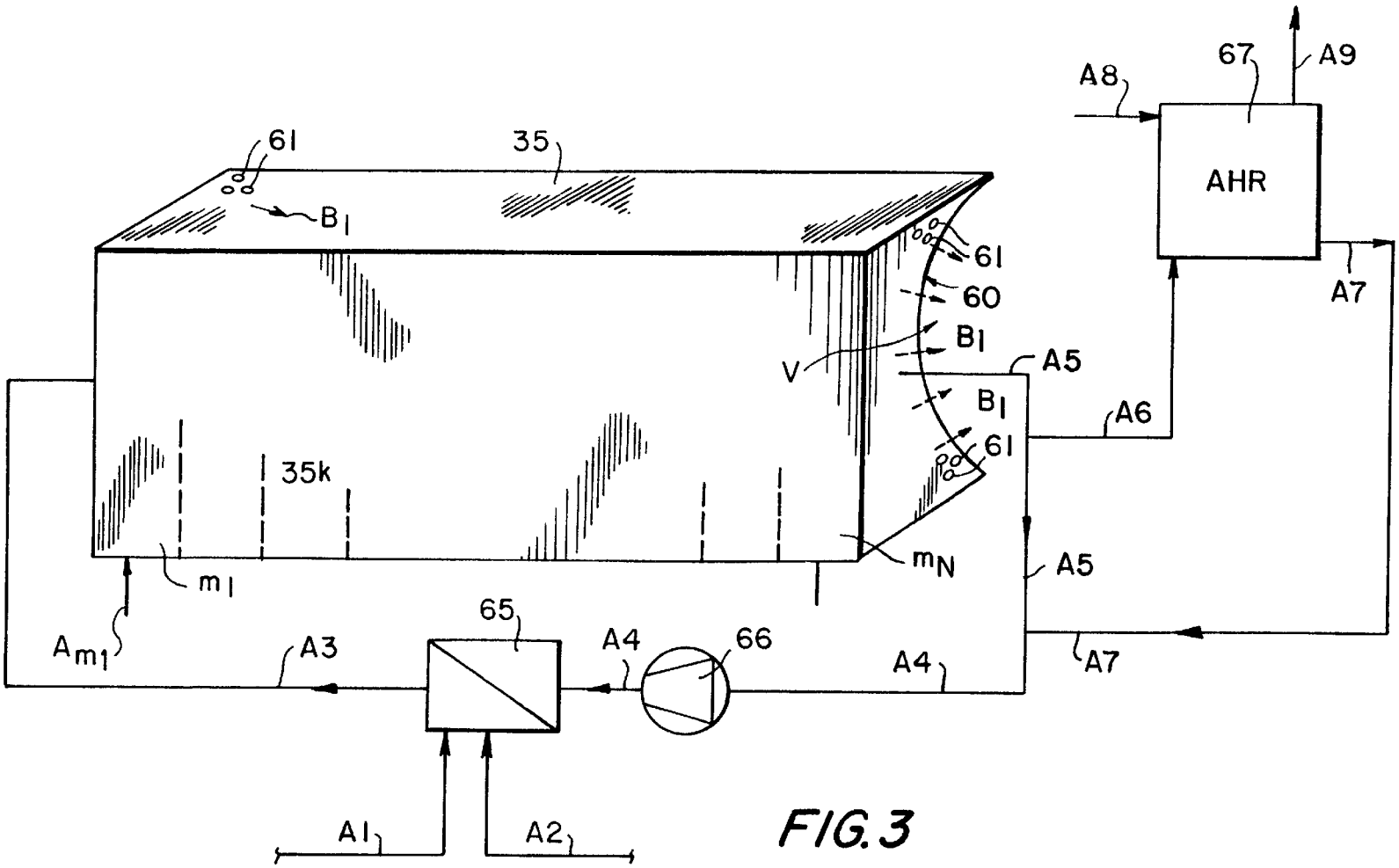
FIG. 3 shows a preferred exemplifying embodiment of the system of circulation of drying gases in connection with an impingement-drying hood module in accordance with the present invention.

FIG. 3 shows an exemplifying embodiment of the arrangement of circulation of the drying gas blown through the hood 35 in the module M. In FIG. 3, a hood half 35 is shown having a nozzle face 60 which follows the curve form of the large cylinder 31, and which is provided with nozzle openings 61 through which the blowings $P_1$ are directed at the outer face of the web W through a narrow gap space V between the nozzle face 60 and the outer face of the web. The radial extension of this space V is of an order of 10 mm to about 50 mm. The circulation arrangement of drying gas comprises a circulation air blower 66 which blows a flow A4 of circulation air to a gas burner 65. A combustion air flow A2 and a fuel gas flow A1 are supplied into the burner 65. From the burner 65, the blow air flow A3 departs into the impingement-drying hood 35. Blowings $B_1$ are blown out of the nozzle openings 61 in the nozzle face 60 against the outer face of the web W, and the temperature of these blowings is in a range of from about 250° C. to about 400° C., preferably about 300° C. The velocity of the blowings $B_1$ is of an order of from about 60 meters per second to about 140 meters per second, preferably about 100 mps.

A moistened air flow A5 is sucked back to circulation out of the space V between the nozzle face 60 and the outer face of the web W. Part of this moistened air is removed as a flow A6 through a heat exchanger unit 67. A dry air flow A8 is passed into the heat exchanger unit 67 and from this unit, a dry heated air flow A7 is taken, which flow is, together with a part A5 of the exhaust flow A5, passed into the circulation air blower 66 to constitute the intake air flow A4 for the blower.

FIG. 3 schematically shows partition walls 35*k* arranged in the hood 35 in the vertical direction and machine direction, by means of which partition walls both of the halves of the hood 35 can be divided into blocks $m_1, \ldots, m_N$. By feeding drying gas flows $Am_1, \ldots, Am_N$ whose condition can be regulated into the blocks $m_1, \ldots, m_N$, respectively, a cross-direction profile of the web W to be dried can be regulated, e.g., on the basis of the signal of measurement of the cross-direction profile, for example moisture profile, given by the measurement frame placed in the dry end of the dryer section.

Figure 4:
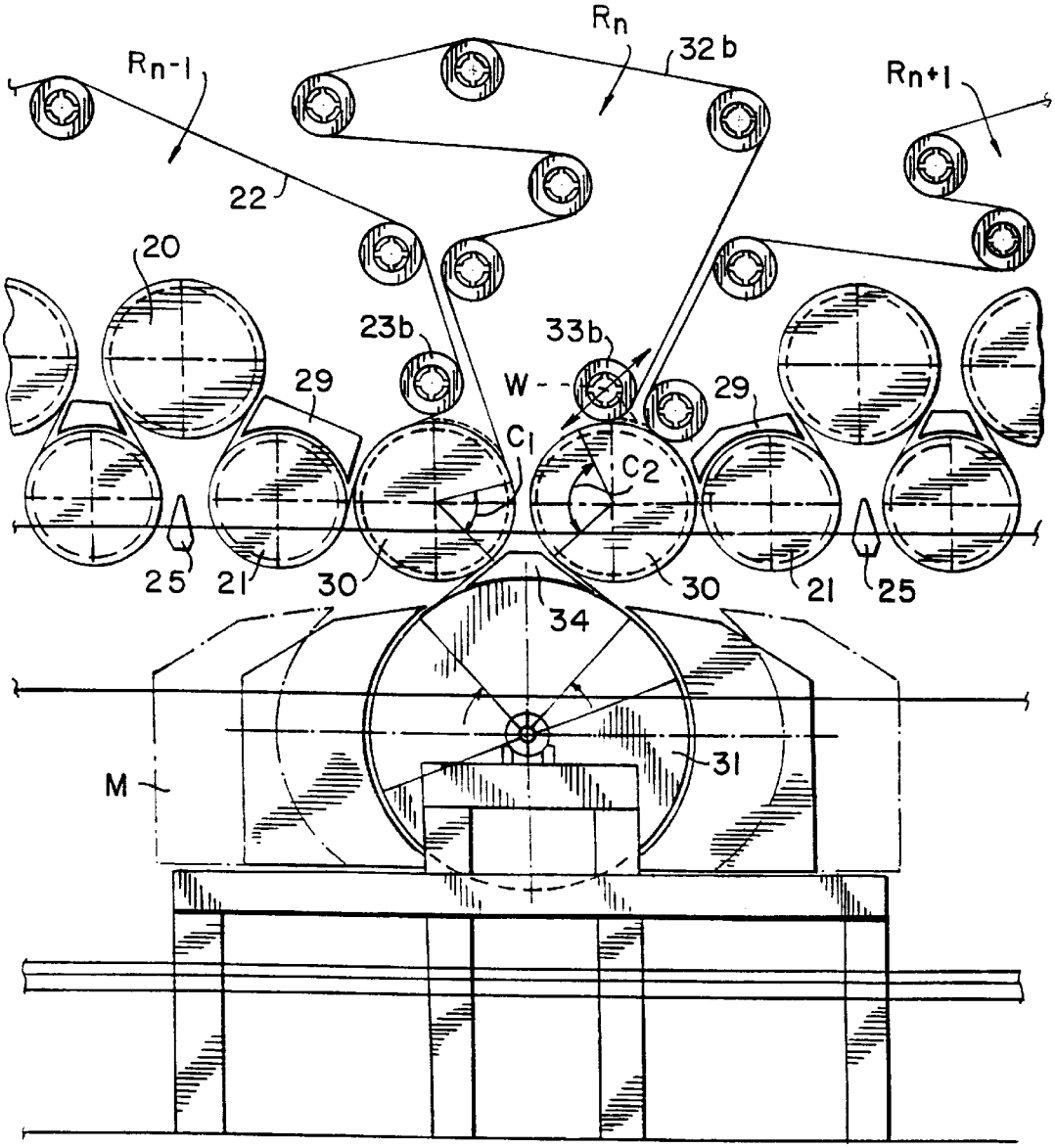
FIG. 4 shows a preferred exemplifying embodiment of a drying unit in accordance with the invention, the preceding group and the following group.

FIG. 4 shows an alternative embodiment of the circulation of the wire 32b in the drying unit $R_n$ and for carrying out the closed draw of the web between the preceding single-wire unit $R_{n-1}$ and the following single-wire unit $R_{n+1}$. The wire 22 of the preceding unit $R_{n-1}$, guided by the wire guide roll 23*b*, is in contact with the first contact-drying cylinder 30 in the unit $R_n$ on a sector of about 45°, in the area of which cylinder 30 the web W is transferred onto the smooth face of the cylinder 30 and further to under the drying wire 32*b* of the unit $R_n$ while turning on the sector $C_1$ onto the large cylinder. Similarly, on the second contact-drying cylinder 30 in the unit $R_n$, the web W is transferred on the sector $C_2$, being pressed by the wire 32*b*, onto the face of the cylinder 30 and on this face further onto the drying wire 22 of the latter group $R_{n+1}$ and on its face further over the first reversing suction cylinder 21 in the unit $R_{n+1}$. The wire 32*b* guide roll 33*b* placed above the latter drying cylinder 30 in the unit $R_n$ can be either stationary or have an adjustable position in view of achieving an optimal closed draw of the web W.

Figure 5:
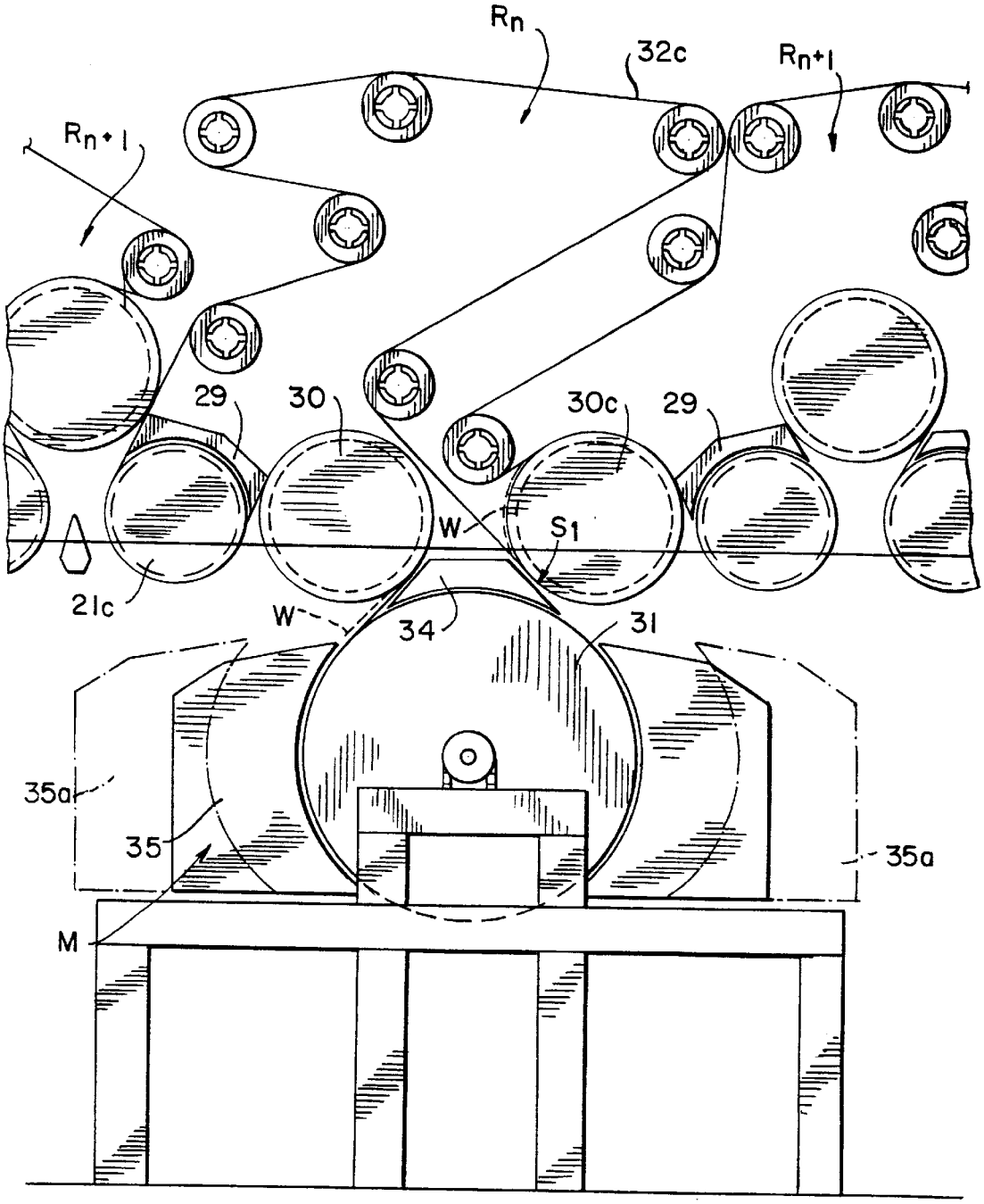
FIG. 5 is an illustration corresponding to FIG. 4 of a second exemplifying embodiment of the draw across a group gap and the wire circulation arrangement.

FIG. 5 shows an alternative embodiment of the arrangement of the closed draw between the drying unit $R_n$ in accordance with the invention and the preceding unit $R_{n-1}$ and the following unit $R_{n+1}$ and the circulation of the wire 32*c* in the unit $R_n$. The wire 32*c* runs over the reversing suction cylinder 21*c*, which is in the position of the last reversing cylinder in the preceding unit $R_{n-1}$ on a sector of about 180°, after which the wire 32*c* and the web W run over the first drying cylinder 30 in the unit $R_n$ on a sector of about 180° and further onto the large cylinder 31 in the module M. From the large cylinder 31, the web W is transferred on the drying wire 32*c* at the transfer point $S_1$ onto the latter drying cylinder 30*c* so that the wire 32*c* contacts the face of the cylinder 30*c* tangentially (although it may also wrap around a sector thereof). The wire 22 of the latter unit $R_{n+1}$ contacts the latter drying cylinder 30*c* on a sector of about 90°. In most other respects, the embodiment of the hood module M is similar to that described above.

Figure 6:
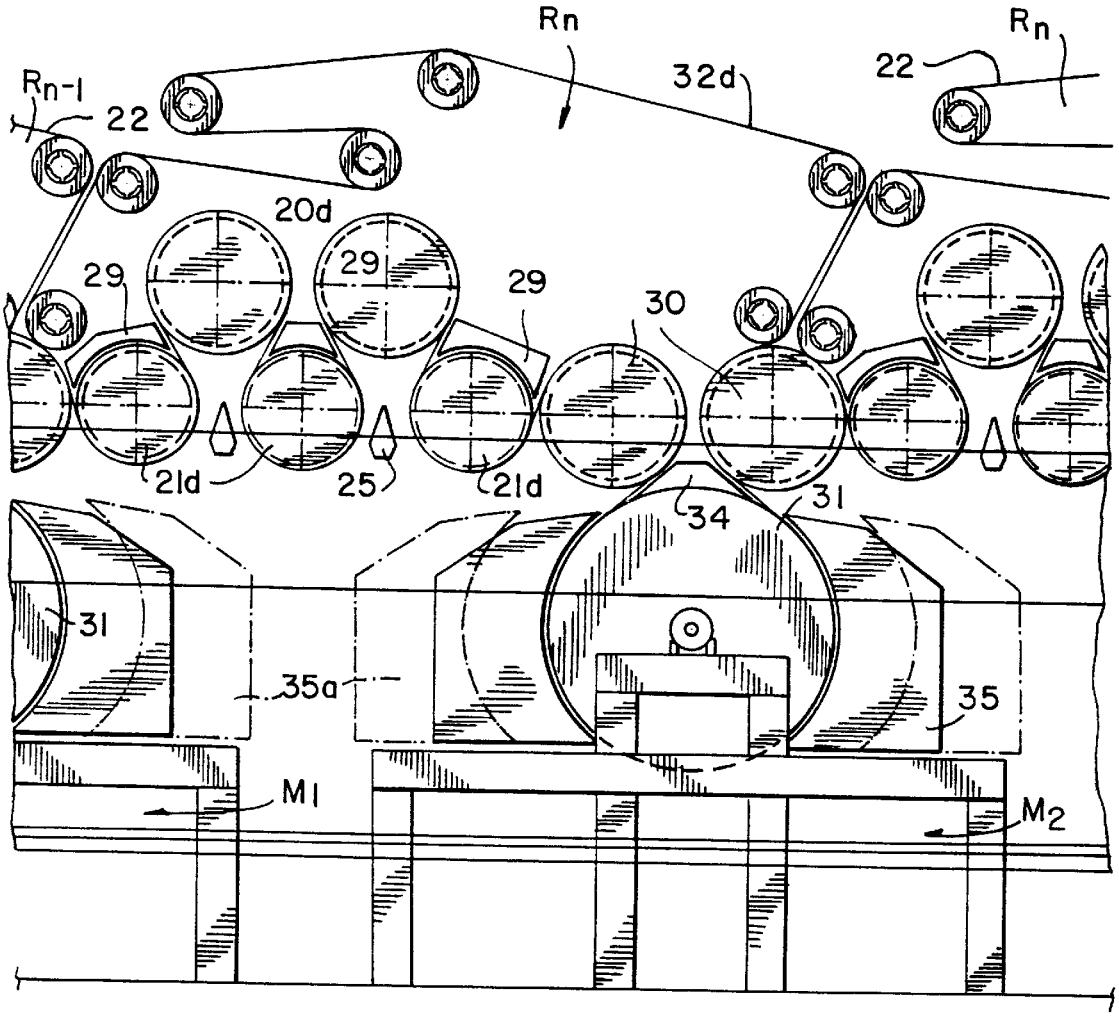
FIG. 6 is an illustration corresponding to FIGS. 4 and 5 of a third exemplifying embodiment of the group-gap draw and of the wire circulation arrangement.

FIG. 6 shows an alternative embodiment of the arrangement of the closed draw of the web W between two successive modules $M_1$ and $M_2$ and the circulation of the wire 32*d* in the unit $R_n$. The drying wire 32*d* of the unit $R_n$ is arranged to run over two drying cylinders 20*d* and three reversing suction cylinders 21*d* so that the drying wire 32*d* forms a sort of a short group with single-wire draw and the drying wire of the latter module $M_2$. From the last reversing suction cylinder 21*d*, the drying wire 32*d* and the web W are passed over the first drying cylinder 30 and further over the large cylinder 31 onto the latter drying cylinder 30 and from it further onto the wire 22 of the latter group $R_{n+1}$.

Figure 7:
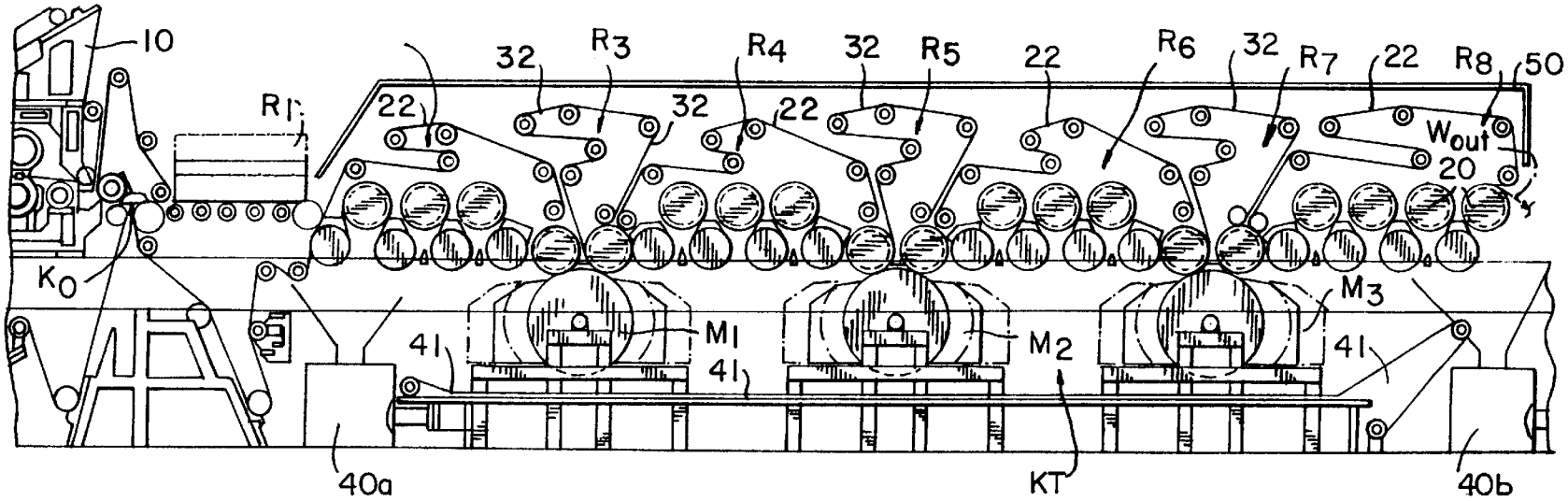
FIG. 7 illustrates a second overall concept of a dryer section in accordance with the invention.

FIG. 7 shows an overall concept of a dryer section in accordance with the invention, which is a modification of the concept shown in FIG. 1. As shown in FIG. 7, the web W, which has been dried in the press section 10 to a dry solids content ko of from about 35% to about 55%, is passed along a linear path through the planar drying-wire unit $R_1$. The unit $R_1$ is, for example, similar to that described in relation to FIG. 1. After this, there follows the first group $R_2$ with single-wire draw open towards the bottom, and after that the first drying unit $R_3$ in accordance with the invention provided with a module $M_1$. Thereafter, a group $R_4$ with single-wire draw provided with three drying cylinders 20 is situated, and then the second drying unit $R_5$ in accordance with the invention provided with a module $M_2$. After the drying unit $R_5$, there follows again a single-wire group $R_6$ provided with three drying cylinders 20 and the third drying unit $R_7$ in accordance with the invention provided with a module $M_3$, and the last group is a group $R_8$ with single-wire draw provided with four drying cylinders 20. Between the groups $R_2$, $R_4$, $R_6$ and $R_8$ with single-wire draw and the drying units $R_3$, $R_5$ and $R_7$ in accordance with the invention, the web W has closed draws, which are shown in FIG. 7 to be accomplished mainly in the manner illustrated in more detail in FIG. 4, but in connection with the overall concept illustrated in FIG. 7, where applicable, it is also possible to employ the group-gap draws and wire circulation arrangements shown in FIGS. 1, 2, 5 and 6. The modules $M_1$,$M_2$ and $M_3$ are similar to that described above and placed in the basement space KT. The removal of broke and the other arrangements are similar to those described above in relation to FIG. 1, or elsewhere herein.

Figure 8:
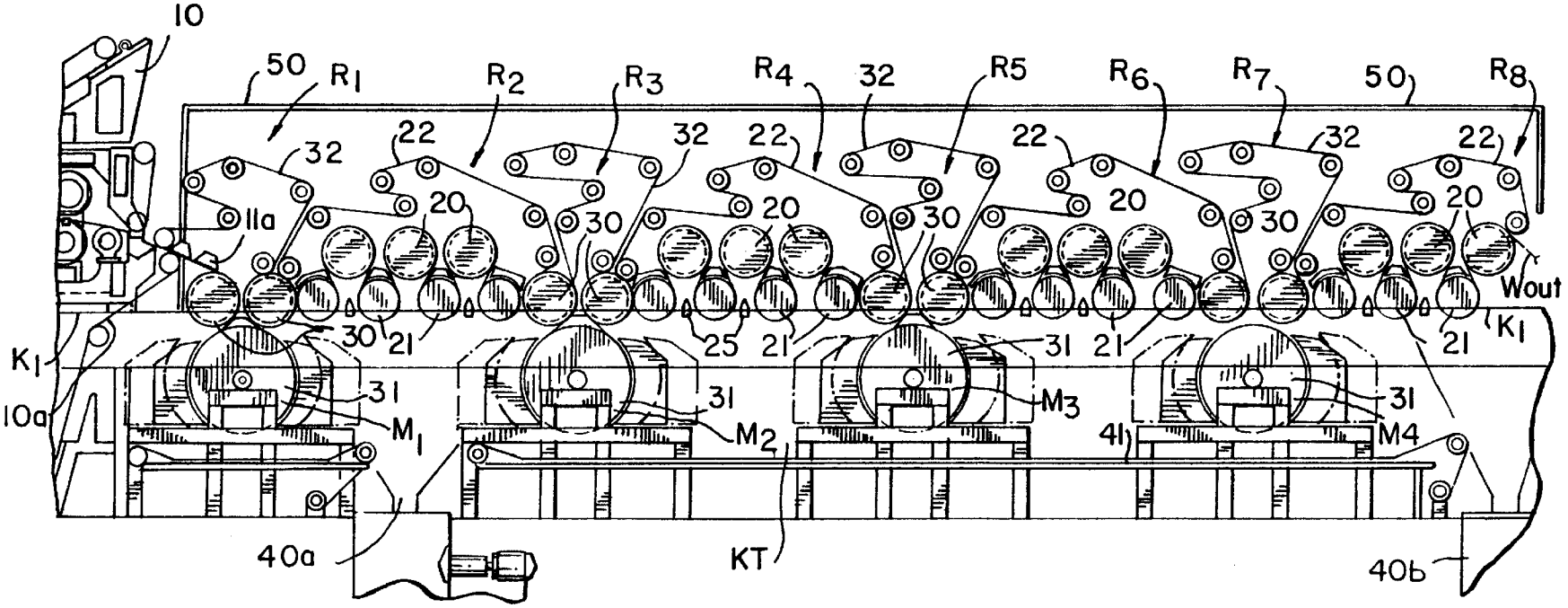
FIG. 8 illustrates a third overall concept of a dryer section in accordance with the invention which includes three impingement-drying hood modules in accordance with the invention and four normal groups with single-wire draw.

FIG. 8 shows an overall concept of a dryer section comprising drying units $R_1$, $R_3$, $R_5$, $R_7$ in accordance with the invention, their modules $M_1$, $M_2$, $M_3$, $M_4$ and groups $R_2$, $R_4$, $P_6$, $R_8$ with single-wire draw. The paper web W to be dried is passed on the lower fabric 10*a* of the press section 10 onto the bottom face of the drying wire 32 of the first group $R_1$ on support of the PressRun™ boxes 11*a*. The first group $R_1$ is a dryer group in accordance with the invention provided with a hood module $M_1$. The group $R_1$ is followed by a normal group $R_2$ with single-wire draw, in which there are three drying cylinders 20 and four reversing suction cylinders 21. The group $R_2$ is again followed by a second dryer group $R_3$ in accordance with the invention, which is provided with a second module $M_2$ placed in the basement space KT, after which there is further a fourth single-wire group $R_4$ provided with three drying cylinders 20 and four reversing suction cylinders 21. This group is followed by a third group $R_5$ in accordance with the invention, which is provided with a hood module $M_3$ placed in the basement space KT. The group $R_5$ is followed by a single-wire group $R_6$ provided with three drying cylinders 20 and four reversing suction cylinders 21, after which there follows the last group $R_7$ in accordance with the invention, which is provided with a fourth hood module $M_4$ placed in the basement space KT. The last group is a single-wire group $R_8$ provided with three drying cylinders and four reversing suction cylinders 21, from which group the web Wout is passed to finishing or to a reel-up. In FIG. 8, the draws of the web W over the group gaps are closed, and they have been accomplished substantially in the way illustrated in FIG. 4, but in the overall concept shown in FIG. 8 it is also possible to use any of the group-gap draws and wire circulation arrangements shown in FIGS. 1, 2, 3, 5 or 6, where applicable. The embodiments of the hood modules $M_1$, . . . ,$M_4$ and the groups $R_1$, $R_3$, $R_5$, $R_7$ are in other respects similar to those described above, or equivalent.

In a dryer section as illustrated in FIGS. 1 and 7 the drying is carried out so that, in the first wire group $R_1$, the drying energy is applied to the web from the side of its top face. After this, in the groups $R_2$, . . . ,$R_{10}$ (FIG. 1) or in the groups $R_2$, . . . ,$R_8$ (FIG. 7), the drying energy is applied to the web exclusively from the side of its bottom face. If tendencies of curling occur in this connection, they can be compensated for in the finishing treatment of the web or in some other ways in themselves known, as stated above.

In FIG. 8, the drying of the web is carried out by applying drying energy to the web exclusively from the side of its bottom face, in which case a compensation for the tendency of curling of the web is often necessary.

By means of the present invention and in particular by means of the overall concepts illustrated in FIGS. 1 and 7, it is favorably possible to carry out the novel three-stage optimal drying method that is described in more detail in the current assignee's Finnish Patent Application No. 971714. In respect of the drying method and preferred embodiments of the different drying parameters, reference is made to this Finnish patent application, and what is stated in this Finnish patent application is not considered necessary to repeat herein in this respect.

Above, some preferred embodiments of the invention have been described, and it is obvious to a person skilled in the art that numerous modifications can be made to these embodiments within the scope of the inventive idea defined in the accompanying patent claims. As such, the examples provided above are not meant to be exclusive. Many other variations of the present invention would be obvious to those skilled in the art, and are contemplated to be within the scope of the appended claims.

We claim:

1. A drying module for a dryer section of a paper or board machine situated in a paper machine hall having a floor level, the drying module comprising a drying wire guided in a loop, a large-diameter impingement-drying and/or through-drying cylinder arranged in said loop of said drying wire and below the floor level of the paper machine hall, said drying wire being guided over said large-diameter cylinder such that a contact sector of said drying wire over said large-diameter cylinder is greater than about 180°, a blow hood arranged around said large-diameter cylinder and having an open position and a closed position, said blow hood being situated at least partially below the floor level of the machine hall, and a pair of smooth-faced heated contact-drying cylinders having a diameter smaller than a diameter of said large-diameter cylinder, each of said pair of contact-drying cylinders being situated on a respective side of said large-diameter cylinder at least one of above said large-diameter cylinder and proximate said large-diameter cylinder, said contact-drying cylinders having a respective central axis situated proximate or above the floor level of the paper machine hall.

2. The drying module of claim 1, wherein the diameter of said large-diameter cylinder is from about 2 m to about 8 m and the diameter of each of said contact-drying cylinders is from about 1.5 m to about 2.5 m, said drying wire being guided over said large-diameter cylinder such that said contact sector of said drying wire over said large-diameter cylinder is from about 200° to about 300°.

3. The drying module of claim 1, wherein said blow hood comprises two hood halves placed one against the other and actuator means coupled to each of said hood halves for moving said hood halves between the hood open position and the hood closed position, further comprising a broke conveyor arranged underneath said hood such that while in the hood open position, the removal of broke from said hood takes place by the force of gravity onto said broke conveyor through an opening between said hood halves.

4. The drying module of claim 3, wherein said hood halves are arranged against each other when in the hood closed position and symmetric in relation to a vertical plane placed through a central axis of said large-diameter cylinder in a cross direction of the machine.

5. The drying module of claim 3, wherein each of said hood halves comprises a nozzle face having nozzle openings and a curve form corresponding to a curvature of said large-diameter cylinder, said hood halves being arranged such that said nozzle faces are adapted to be at a small distance from an outer face of a web to be dried operatively supported by said drying wire, further comprising circulation means for circulating drying gas into an interior of said hood and into a narrow gap space defined between said nozzle faces of said hood halves and the outer face of the web.

6. The drying module of claim 1, further comprising partition walls arranged in said hood for dividing said hood in a machine direction into a plurality of blocks, said hood being arranged such that independently regulatable drying gas flows are directed into each of said blocks to thereby regulate a cross-direction profile of a web to be dried.

7. The drying module of claim 1, further comprising sealing means for sealing a sector of said large-diameter cylinder situated outside of said contact sector of said drying wire over said large-diameter cylinder.

8. The drying module of claim 7, wherein said sealing means comprise a blow box.

9. The drying module of claim 1, wherein said hood has upper, inclined faces in order to facilitate the removal of broke.

10. The drying module of claim 1, wherein said large-diameter cylinder has axle journals and said blow hood comprises two hood halves placed one against the other and actuator means coupled to each of said hood halves for moving said hood halves between the hood open position and the hood closed position, further comprising frame parts for supporting said axle journals of said large-diameter cylinder, said frame parts comprising horizontal frames for supporting said hood halves, said horizontal frames being supported on a floor level of a basement space below the floor level of the machine hall to thereby define a space between the floor level and said horizontal frames, a broke conveyor arranged in said space between the floor level and said horizontal frames, a partition wall arranged below said broke conveyor and above the floor level to thereby define a space between the floor level and said partition wall, and ducts for drying gas optionally arranged in said space defined between the floor level and said partition wall.

11. A dryer section of a paper machine, comprising a first single-wire draw group including contact-drying cylinders arranged in a first row, reversing suction cylinders or rolls arranged in a second row below said first row and a drying wire for guiding a web over said reversing cylinders and into contact with said contact-drying cylinders, said first single-wire draw group being arranged above the floor level of the machine hall, and a first one of said drying module of claim 1.

12. The dryer section of claim 11, wherein a first dryer group in the dryer section arranged before said first single-wire draw group and said first drying module is a drying-wire unit comprising a drying wire, guide rolls for guiding said drying wire in a loop such that said drying wire is adapted to receive the web from a press section preceding the dryer section and carry the web in a run of said drying wire, and means arranged above said run of said drying wire for directing at least one of a drying gas flow and radiation at the web without contacting the web.

13. The dryer section of claim 11, further comprising a second single-wire draw group, said first drying module being arranged between said first and second single-wire draw groups, said first drying module further comprising a reversing cylinder arranged before a first one of said contact-drying cylinders in a running direction of said drying wire and inside said loop of said drying wire of said first drying module, said contact-drying cylinders being arranged outside of said loop of said drying wire of said first drying module, said drying wire of said first drying module being arranged to receive a web from said drying wire of said first single-wire draw group preceding said first drying module in the running direction of the web and run around said reversing cylinder, then over said first contact-drying cylinder, then over said large-diameter cylinder and then over a second one of said contact-drying cylinders, the web being transferred from said drying wire of said first drying module to said drying wire of said second single-wire draw group following said first drying module.

14. The dryer section of claim 11, wherein said first single-wire draw group is arranged before said first drying module in a running direction of a web, said drying wire of said first single-wire draw group being guided to wrap around a first one of said contact-drying cylinders in said first single-wire draw group such that the web is passed by said drying wire of said first single-wire draw group onto said first contact-drying cylinders and carried over said first contact-drying cylinder into engagement with said drying wire of said first drying module.

15. The dryer section of claim 11, wherein said first single-wire draw group is arranged after said first drying module in a running direction of a web, said drying wire of said first single-wire draw group being guided to carry the web onto a second one of said contact-drying cylinders in said first single-wire draw group such that the web is passed by said drying wire of said first drying module onto said second contact-drying cylinders and carried over said second contact-drying cylinder into engagement with said drying wire of said first single-wire draw group.

16. The dryer section of claim 11, wherein said first drying module further comprises at least one additional contact-drying cylinder arranged in a first row above said pair of contact-drying cylinders, and at least one additional reversing cylinders arranged in a second row below said first row of at least one additional contact-drying cylinder, said drying wire of said first drying module being guided over said at least one additional contact-drying cylinder and said at least one additional reversing cylinder.

17. The dryer section of claim 11, further comprising at least a second and third single-wire draw group and at least a second drying, module, each of said first and second drying modules being arranged between two of said single-wire draw groups.

18. The dryer section of claim 11, further comprising at least a second drying module and at least a second single-wire draw group, only a portion of said single-wire draw groups being arranged between a respective pair of said drying modules, one of said single-wire draw group being a last group in the dryer section.

19. The dryer section of claim 11, further comprising second and third drying modules and second, third and fourth single-wire draw groups, further comprising a first drying-wire group arranged before said drying modules and before said single-wire draw groups in a running direction of the web, said first group comprising means for applying at least one of an intensive blowing of drying gas and electromagnetic radiation to a top face of the web without contact with the web, said first single-wire draw group being arranged after said first group, said first drying module being arranged after said first single-wire draw group, said second single-wire draw group being arranged after said first drying module, said second drying module being arranged after said second single-wire draw group, said third single-wire draw group being arranged after said second drying module, said third drying module being arranged after said third single-wire draw group, and said fourth single-wire draw group being arranged after said third drying module.

20. The dryer section of claim 19, further comprising a broke conveyor arranged below said first, second and third drying modules, all of said single-wire draw groups being open towards the bottom and said drying modules being open towards the bottom such that removal of broke is carried out by the force of gravity onto said broke conveyor.

21. The dryer section of claim 11, further comprising a broke conveyor arranged below said first drying module and above a floor level, a pulper arranged to receive broke from said broke conveyor, said pulper being arranged at least at one end of said conveyor, and ducts for drying gas optionally arranged between the floor level and said broke conveyor.

22. The dryer section of claim 11, wherein the web is arranged to be dried over the entire length of the dryer section from a side of its bottom face only.

23. The dryer section of claim 11, further comprising a first wire group in a running direction of a web, said first group comprising means for applying drying energy to the web to a top face of the web, said at least one drying module and said at least one single-wire draw group being arranged after said first wire group and to dry a web from a side of its bottom face only.

* * * * *